US006393739B1

(12) United States Patent
Shamblin et al.

(10) Patent No.: US 6,393,739 B1
(45) Date of Patent: May 28, 2002

(54) EXCAVATING TOOTH POINT AND ADAPTER APPARATUS

(75) Inventors: Wayne A. Shamblin, Burleson; John A. Ruvang, Hickory Creek; Howard W. Robinson, Grapevine, all of TX (US)

(73) Assignee: G. H. Hensley Industries, Inc., Dallas, TX (US)

( * ) Notice: Subject to any disclaimer, the term of this patent is extended or adjusted under 35 U.S.C. 154(b) by 0 days.

(21) Appl. No.: 09/931,118

(22) Filed: Aug. 16, 2001

(51) Int. Cl.[7] ..... E02F 9/28
(52) U.S. Cl. ..... 37/456
(58) Field of Search ..... 37/452, 453, 454, 37/455, 456, 457, 458; 172/772, 772.5

(56) References Cited

U.S. PATENT DOCUMENTS

| | | | | |
|---|---|---|---|---|
| 821,215 | A | 5/1906 | Cantlebery et al. | |
| 1,234,114 | A | 7/1917 | Andrews | |
| 1,330,143 | A | 2/1920 | Seal | |
| 1,837,341 | A | 12/1931 | Shaffer | |
| 1,856,706 | A | 5/1932 | Holcomb | |
| 2,124,230 | A | 7/1938 | Hosmer et al. | 37/142 |
| 2,145,663 | A | 1/1939 | Reynolds | 37/141 |
| 2,740,212 | A | 4/1956 | Werkheiser et al. | 37/142 |
| 2,915,290 | A | 12/1959 | Petersen | 255/70 |
| 3,117,386 | A | 1/1964 | Ferwerda | 37/142 |
| 3,496,658 | A | 2/1970 | Eyolfson | 37/142 |
| 3,708,895 | A | 1/1973 | Griffith et al. | 37/142 A |
| 4,481,728 | A | 11/1984 | Mulder et al. | 37/142 A |
| 5,144,762 | A | 9/1992 | Robinson | 37/141 T |
| 5,177,886 | A | 1/1993 | Klett | 37/141 T |
| 5,379,535 | A | 1/1995 | Bowes, Jr. | 37/452 |
| 5,617,655 | A | 4/1997 | Launder et al. | 37/457 |
| 6,018,896 | A | 2/2000 | Adamic | 37/456 |
| 6,030,143 | A | 2/2000 | Kreitzberg | 403/374.1 |
| 6,047,487 | A | 4/2000 | Clendenning | 37/452 |
| 6,079,132 | A | 6/2000 | Clendenning | 37/457 |

FOREIGN PATENT DOCUMENTS

| | | |
|---|---|---|
| WO | WO99/16982 | 4/1999 |

OTHER PUBLICATIONS

Sketch of Hendrix Co. Adapter Nose—Manufactured Since At Least 1991.

*Primary Examiner*—Christopher J. Novosad
(74) *Attorney, Agent, or Firm*—Konneker & Smith, P.C.

(57) ABSTRACT

An elongated excavating tooth assembly includes a replaceable tooth point and an adapter structure comprising (1) an intermediate adapter having a front end nose complementarily received in a rear end pocket of the point and captively retained therein by a first connector pin structure, and (2) a main adapter having a front end nose complementarily received in a rear end pocket of the intermediate adapter and captively retained therein by a second connector pin structure, and a rear end operatively securable to an excavating bucket lip. Special configurations of the point and adapter portions of the assembly, including horizontally elongated oval configurations of the noses, horizontal orientation of the connector pins, nose stabilization bosses at the nose connector openings, and complementarily scalloped adapter and point interface areas, provide the assembly with reduced size and improved strength, wear and operational characteristics.

40 Claims, 4 Drawing Sheets

EXCAVATING TOOTH POINT AND ADAPTER APPARATUS

BACKGROUND OF THE INVENTION

The present invention generally relates to excavating apparatus and, in a preferred embodiment thereof, more particularly provides a uniquely configured excavating tooth point and adapter assembly representatively including a tooth point connected to an adapter section having interconnected main and intermediate portions.

Large excavating buckets, dippers and the like are typically provided with a series of earth-cutting tooth assemblies each comprising a relatively large adapter section and a relatively small replaceable tooth point. The adapter section has a base portion which is connectable to the forward lower lip of the bucket, and a tapered nose portion onto which the tooth point is removably secured, with the tapered adapter nose being received in an interior pocket portion of the point, by a suitable connecting pin or other connecting structure. Compared to that of the adapter section, the useful life of the point is rather short, the adapter section typically lasting through several point replacements until the tremendous earth forces and abrasion to which the adapter section is subjected necessitates its replacement. Thus, the point may be characterized as a wear member, and the adapter section may be characterized as a support structure carrying the wear member and protected thereby against premature replacement.

The adapter section may be a single adapter, or may be formed from a primary adapter which is connectable to the bucket lip, and an intermediate adapter which is interposed between the replaceable tooth point and the primary adapter and releasably connected to them. The intermediate adapter has a front nose portion which is captively and releasably retained within a complementarily configured rear end pocket area of the point by a first connector structure, and the main adapter has a front nose portion which is captively and releasably retained within a complementarily configured pocket area in the rear end of the intermediate adapter by a second connector structure. Thus, the replaceable tooth point functions as a wear member carried on and protecting the intermediate adapter, with the intermediate adapter functioning both as a support structure for the point and a wear member for the main adapter which supports the intermediate adapter.

Designing the configuration of an adapter nose, its interfit with its associated wear member (such as a point or another adapter), and its relationship with the connector structure used to releasably couple the adapter nose to the associated wear member, presents a variety of engineering challenges. For example, to maximize the earth penetration capabilities of a particular adapter/tooth point assembly the frontal cross-section of the assembly must be as small as possible. However, in adapter/tooth point assemblies of conventional designs reductions in such frontal cross-sectional area correspondingly weakens the assembly. Other design challenges include preventing undue operational stresses from being imposed on the wear member/support member connector apparatus, configuring the nose to reduce operational stress concentrations thereon, stabilizing each wear member against excess movement relative to its associated support member during excavating operations, and optimizing the abrasion protection provided to each support member by its associated wear member.

It would be desirable for both economic and operational reasons to provide an adapter/tooth point assembly having improvements in one or more of these design areas. It is to this goal that the present invention is primarily directed.

SUMMARY OF THE INVENTION

In carrying out principles of the present invention, in accordance with a preferred embodiment thereof, a specially configured excavating equipment wear member/support member assembly is provided which extends lengthwise along a front-to-rear assembly axis and representatively includes a replaceable tooth point, an intermediate adapter, and a main adapter. The tooth point is telescoped onto and captively retained on a forwardly projecting nose portion of the intermediate adapter, and the intermediate adapter is telescoped onto and captively retained on a forwardly projecting nose portion of the main adapter. The main adapter has a rear end portion which is releasably securable to a front edge portion of an excavating bucket lip.

The nose portion of the intermediate adapter projects forwardly from a front end surface of a rear base portion of the adapter, which representatively circumscribes the rear end of the nose portion, and has a horizontally elongated, generally elliptical cross-section along substantially its entire front-to-rear length, top and bottom surfaces, and horizontally opposite left and right surfaces. Horizontally opposite stabilizing projections are disposed on and project laterally outwardly from he left and right surfaces of the nose portion, and a connector opening extends horizontally through the nose portion and opens outwardly through the stabilizing projections. Preferably, the stabilizing projections are stabilizing bosses having rectangular configurations, are positioned adjacent the front end surface of the rear base portion of the intermediate adapter, and extend through only a relatively small portion of the front-to-rear length of the nose portion.

The intermediate adapter nose is complementarily received in a rear end cavity of the tooth point, with horizontally opposite connector openings extending through opposite left and right side walls of the tooth point into interior side recesses therein which complementarily receive the stabilizing bosses on the intermediate adapter nose. The tooth point connector openings are in an outwardly overlying align ed relationship with opposite ends of the intermediate adapter nose connector opening, and a connector structure, representatively a front connector pin, horizontally extends through the point and adapter connector openings and captively retains the tooth point on the intermediate adapter nose.

Preferably, the top and bottom surfaces of the intermediate adapter nose are substantially parallel to the front-to-rear assembly axis, and the top and bottom nose surfaces have front portions which are vertically inset from the balance of the top and bottom nose surfaces.

The main adapter has a rear base portion with a front end surface from which a nose portion forwardly projects, the main adapter nose portion having a configuration similar to that of the intermediate adapter nose, and is similarly provided with outwardly projecting stabilizing bosses on opposite left and right sides thereof, a connector opening extending horizontally through the main adapter nose and opening outwardly through its stabilizing bosses. The main adapter nose and its associated stabilizing bosses are complementarily received within a rear end cavity of the rear base portion of the intermediate adapter. The main adapter nose connector opening is aligned with left and right side wall connector openings formed in the base portion of the intermediate adapter, and a connector structure, representatively in the form of a rear connector pin, extends through the aligned connector openings and captively retains the intermediate adapter on the nose of the main adapter.

Facing front and rear end surfaces of the intermediate adapter base portion and the tooth point have alternately scalloped portions around their peripheries, the scalloped peripheries being complementarily engaged in an interlocking configurational relationship. Preferably, top and bottom portions of the front end surface of the rear base portion of the intermediate adapter have forwardly convex arcuate configurations, and left and right side portions of the front end surface of the rear base portion of the intermediate adapter have rearwardly concave arcuate configurations. In this manner, the front connector pin location may be advantageously positioned further rearwardly on the intermediate adapter.

In a similar manner, facing front and rear end surfaces of the main adapter base portion and the intermediate adapter have alternately scalloped portions around their peripheries, the scalloped peripheries being complementarily engaged in an interlocking configurational relationship. Preferably, top and bottom portions of the front end surface of the rear base portion of the main adapter have rearwardly concave arcuate configurations, and left and right side portions of the front end surface of the rear base portion of the main adapter have forwardly convex arcuate configurations. In this manner, top and bottom side portions of the intermediate adapter extend rearwardly over corresponding underlying portions of the main adapter and provide enhanced wear protection for the main adapter.

Compared to tooth point/adapter assemblies of conventional configurations, the complementary configurations of the adapter noses and their associated point and adapter cavities provide the tooth point/adapter assembly with a variety of advantages including smaller size with similar strength, reduced frontal area which facilitates assembly earth penetration, enhanced rotational stability among the tooth and adapter components, and reduced operational stresses on the connector pins. While the illustrated embodiment of the invention includes a two-piece adapter section, it will be readily appreciated by those of skill in this particular art that the adapter section could alternatively be defined, if desired, by a single adapter member. Additionally, while principles of the present invention have been representatively illustrated herein as being embodies in a tooth point and adapter assembly, it will further be appreciated by those of skill in this particular art that such principles could also be utilized to advantage in other types of excavating equipment wear member/support member assemblies as well.

DETAILED DESCRIPTION

Figure 1:
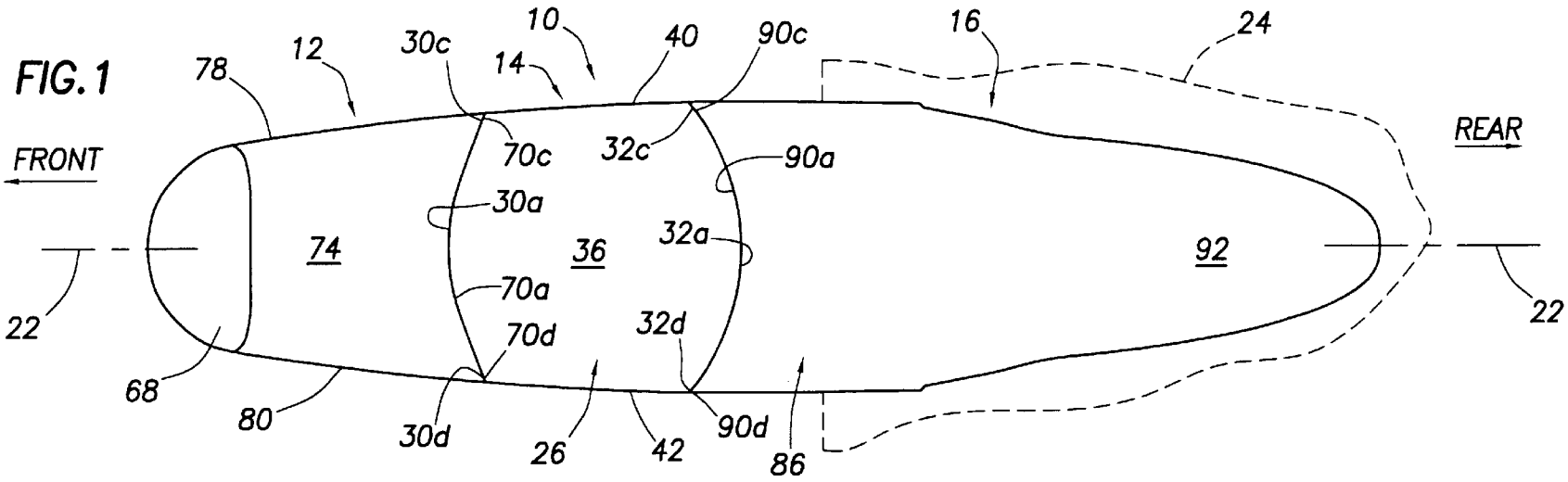
FIG. 1 is a top plan view of an excavating tooth point and adapter assembly embodying principles of the present invention.
Figure 2:
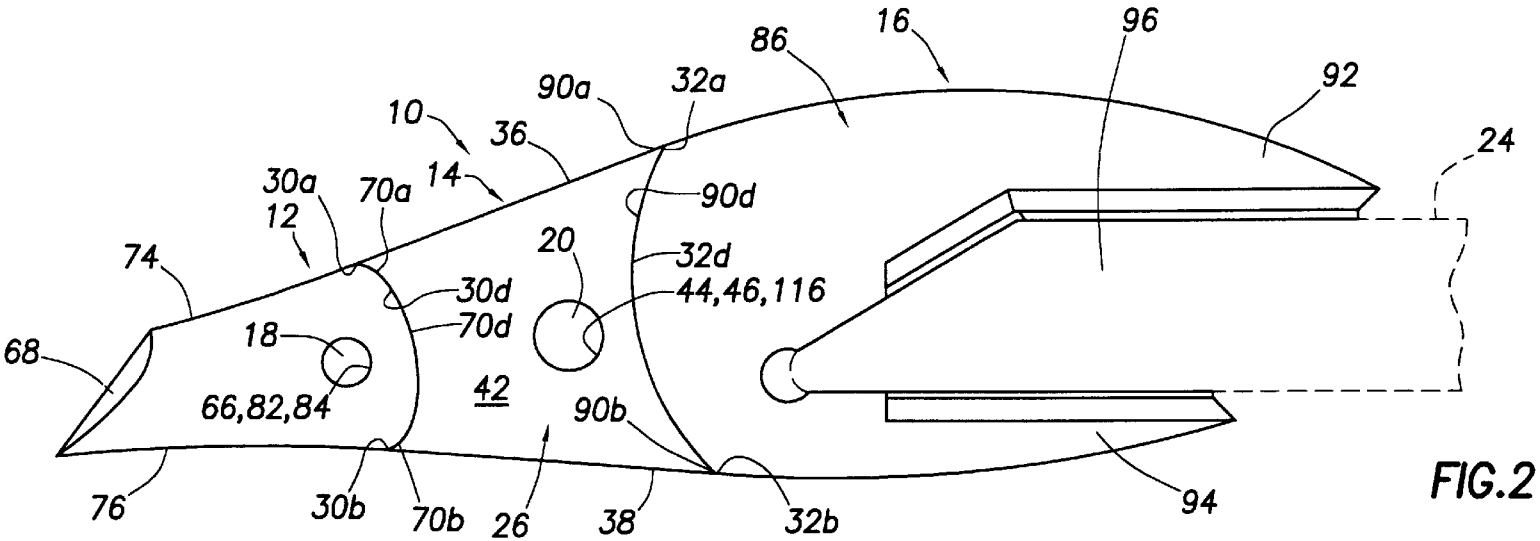
FIG. 2 is a side elevational view of the assembly.
Figure 3:
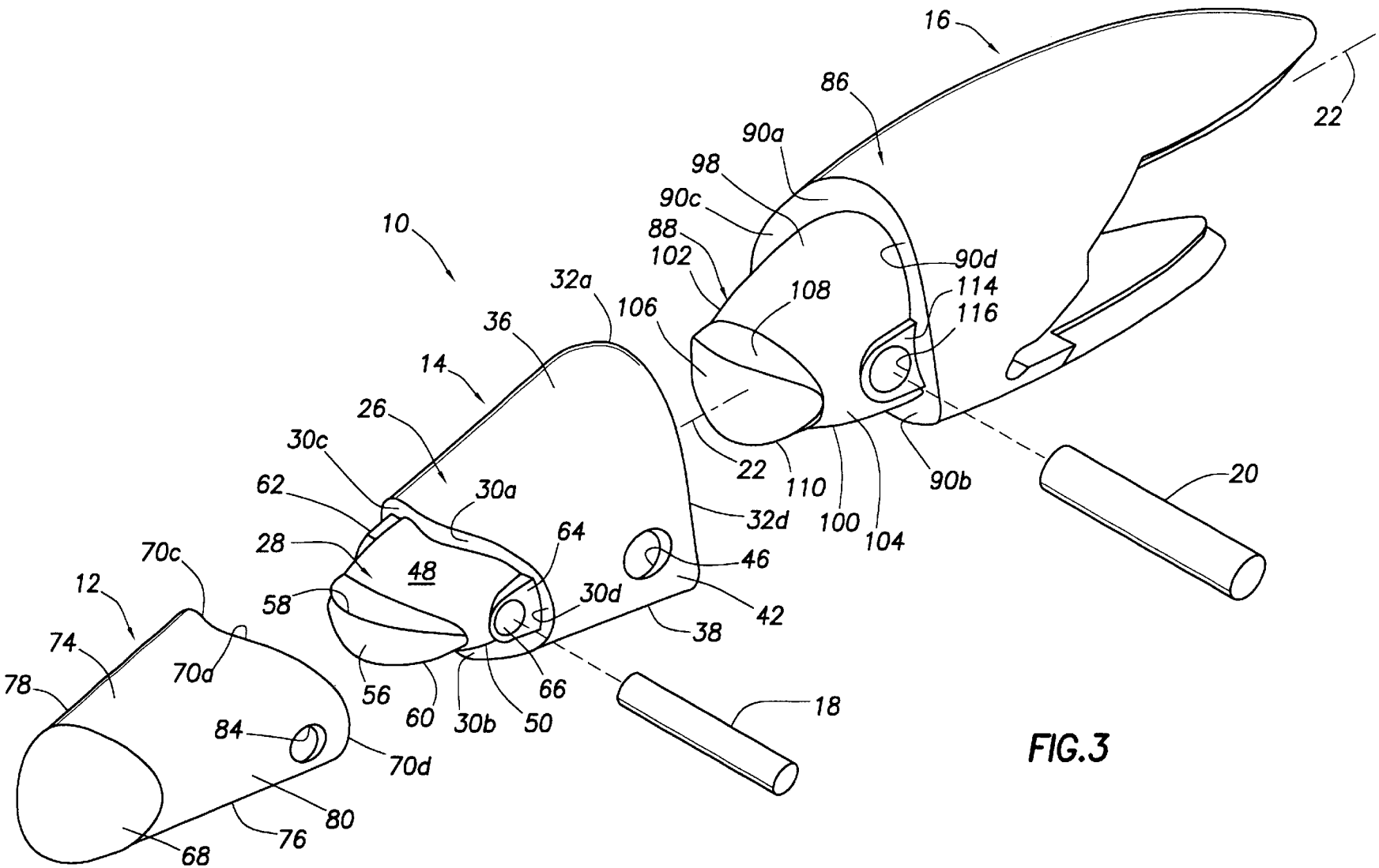
FIG. 3 is an exploded perspective view of the assembly.
Figure 4:
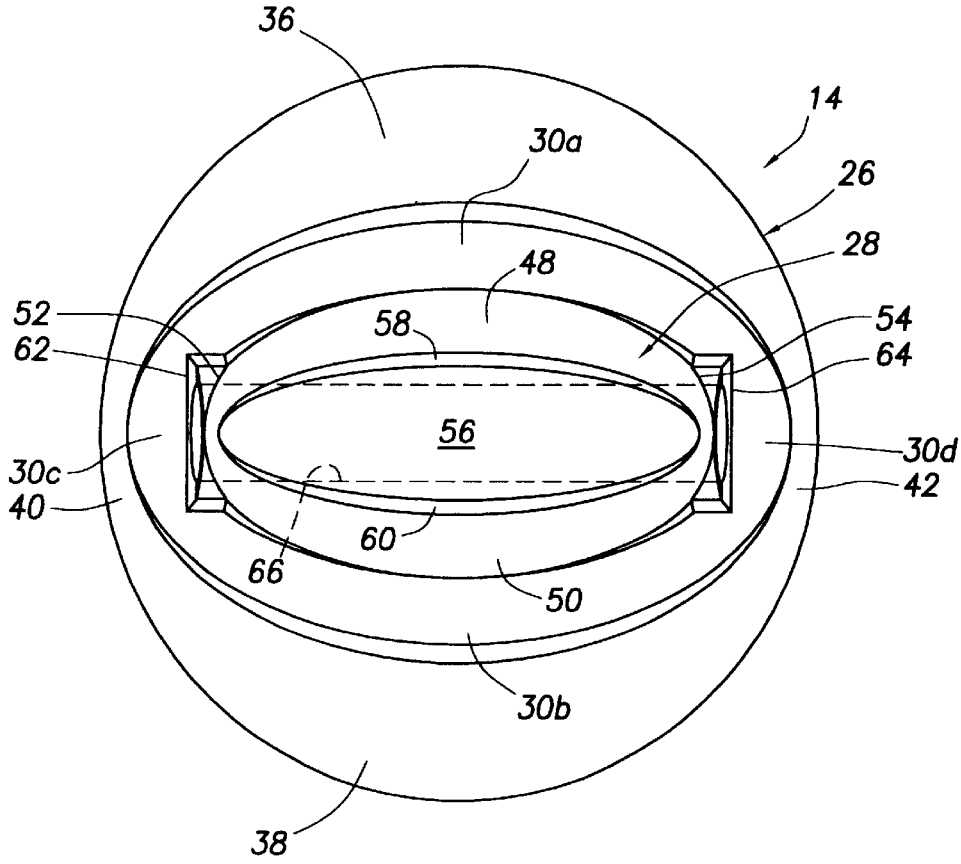
FIG. 4 is an enlarged scale front end view of an intermediate adapter portion of the assembly.
Figure 5:
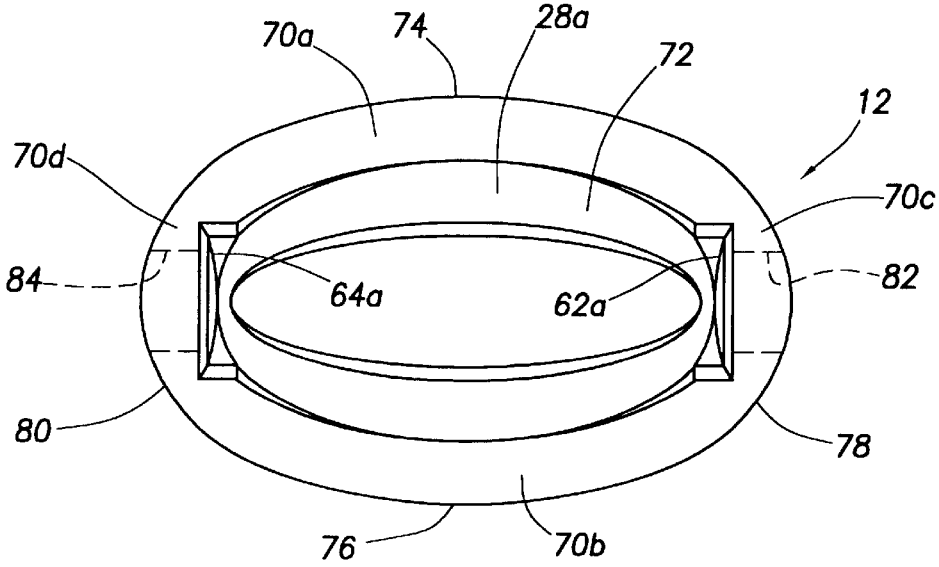
FIG. 5 is an enlarged scale rear end view of a tooth point portion of the assembly.
Figure 6:
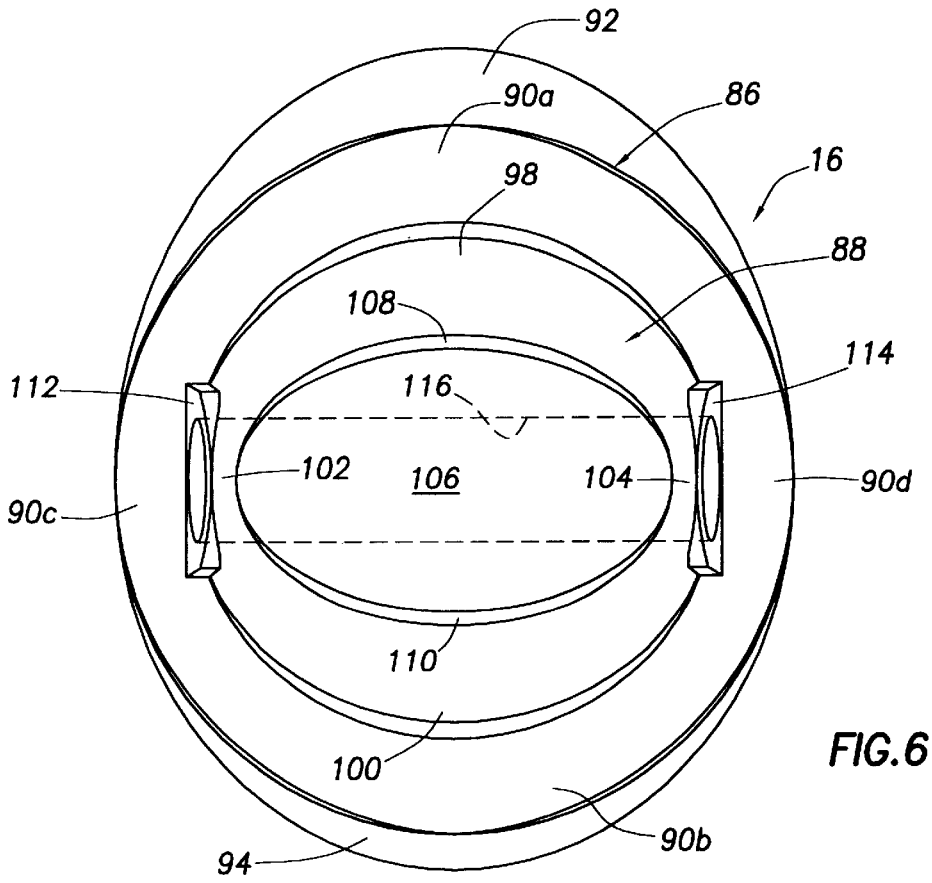
FIG. 6 is an enlarged scale front end view of a main adapter portion of the assembly.
Figure 7:
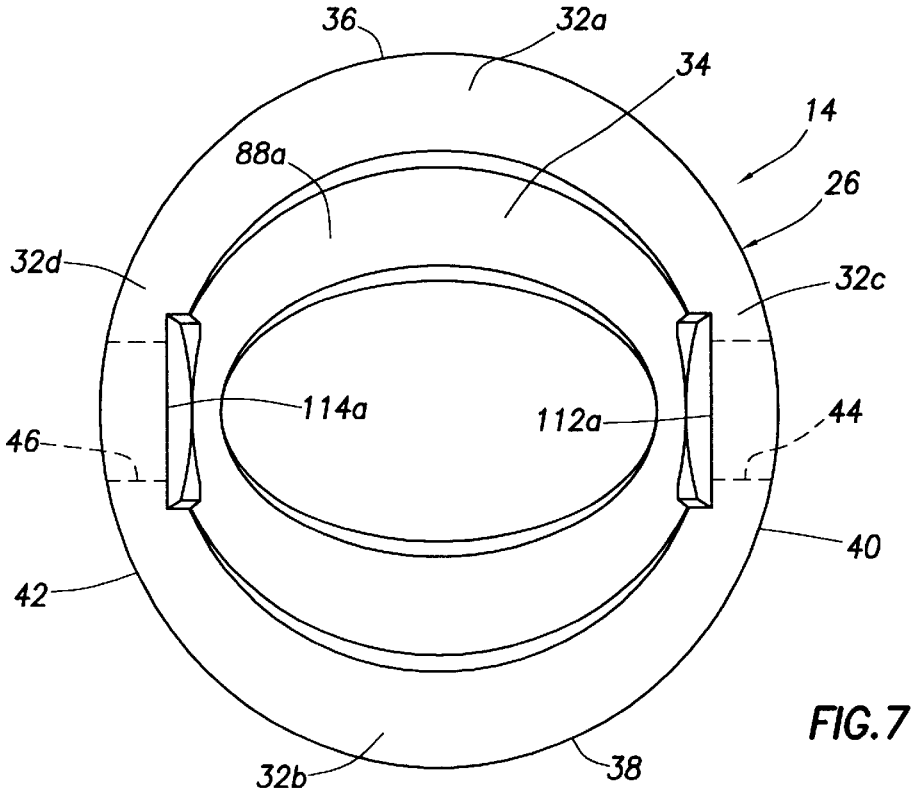
FIG. 7 is an enlarged scale rear end view of the intermediate adapter.

Referring initially to FIGS. 1–3, the present invention provides a specially configured excavating tooth point and adapter assembly 10 which representatively includes a replaceable tooth point 12, an intermediate adapter 14, a main adapter 16, a first connector structure illustratively in the form of a schematically depicted connector pin 18, and a second connector structure illustratively in the form of a schematically depicted connector pin 20. The assembly 10 is elongated in a front-to-rear direction along a longitudinal axis 22, and is anchored to and projects forwardly beyond a front edge portion of a bottom excavating bucket lip 24, a small section of which is illustrated in phantom in FIGS. 1 and 2. Assembly 10 is one of a spaced, parallel series of such assemblies (the other ones of which are not illustrated) similarly attached to and projecting forwardly beyond the lip 24.

With reference now to FIGS. 1–4 and 7, the intermediate adapter 14 has a rear base portion 26 and a front nose portion 28. Base portion 26 has a front end surface 30 from which the nose 28 forwardly projects, a rear end surface 32 inwardly through which a cavity 34 extends, top and bottom walls 36 and 38, and left and right side walls 40 and 42. Aligned connector openings 44 and 46 respectively extend through the left and right side walls 40 and 42 into the cavity 34. The front end surface 30 of the adapter base 26 is alternately scalloped in a front-to-rear direction around its periphery, with the top and bottom portions 30*a*,30*b* of the front end surface 30 being convexly curved in a forward direction, and the left and right portions 30*c*,30*d* of the front end surface 30 being concavely curved in a rearward direction. Similarly, the rear end surface 32 of the adapter base 26 is alternately scalloped in a front-to-rear direction around its periphery, with the top and bottom portions 32*a*,32*b* of the rear end surface 32 being convexly curved in a rearward direction, and the left and right portions 32*c*,32*d* of the rear end surface 32 being concavely curved in a forward direction.

The intermediate adapter nose 28 has, along its front-to-rear length, a horizontally elongated elliptical cross-section, with top and bottom surfaces 48,50 and left and right side surfaces 52 and 54. Except for a slight draft angle of 5 degrees or less, the top and bottom surfaces 48,50 are substantially parallel to the assembly axis 22. At the front end of the nose 28 is a reduced cross-section stabilizing tip 56 having a horizontally elongated elliptical cross-section and top and bottom surfaces 58 and 60 which are also substantially Parallel to the assembly axis 22. Laterally outwardly projecting stabilizing bosses 62 and 64 are respectively formed on the left and right side surfaces 52,54 of the adapter nose 28 at their junctures with the front end surface 30 of the adapter base 26. A connector opening 66 horizontally extends through the adapter nose 28 and opens outwardly through the bosses 62 and 64.

With reference now to FIGS. 1–3 and 5, the point 12 has a suitable cutting edge 68 formed on its front end, a rear end surface 70 through which a cavity 72 inwardly extends, top and bottom walls 74 and 76, and left and right side walls 78 and 80 through which aligned connector openings 82,84 respectively extend into the interior of the cavity 72. The rear end surface 70 is alternately scalloped around its periphery, having top and bottom portions 70*a*,70*b* which are concavely curved in a forward direction and have curvatures respectively complementary to those of the previously described front end surface portions 30*a*,30*b* of the intermediate adapter base 26, and left and right side portions

70*c*,70*d* which are convexly curved in a rearward direction and have curvatures respectively complementary to those of the previously described front end surface portions 30*c*,30*d* of the intermediate adapter base 26.

Tooth point 12 is replaceably mounted on the intermediate adapter nose 28 by first placing the nose 28 within the tooth point cavity or pocket 72, thereby bringing the point connector openings 82,84 into outwardly overlying alignment with opposite ends of the horizontally oriented adapter nose opening 66, and then operatively inserting the front connector pin 18 in the aligned connector openings 66,82,84. The inserted connector pin 18 is suitably retained in such openings, in a conventional manner not pertinent to the present invention, and functions to captively and releasably retain the point 12 on the intermediate adapter 14, the point 12 serving as a wear member for the intermediate adapter 14 which, in turn, may be characterized as a support member for the mounted point 12.

The tooth point cavity 72 (see FIG. 5) has an interior surface configuration complementary to that of the exterior surface of the intermediate adapter nose 28 which it releasably receives. Specifically, the cavity 72 has a portion 28*a* configured to complementarily receive the body of the inserted intermediate adapter nose 28, and left and right interior side wall recesses 62*a*,64*a* that respectively and complementarily receive the inserted adapter nose stabilizing bosses 62,64. connector openings 82,84 respectively extend laterally inwardly into the recesses 62*a*,64*a*.

The unique shapes of the tooth point 12 and intermediate adapter 14 provide the tooth point/intermediate adapter subassembly 12,14 with a variety of advantages compared to conventional point/adapter assemblies. For example, the horizontally elongated elliptical cross-sectional shape along its length of the intermediate adapter nose 28 substantially eliminates planar areas on the nose 28, thereby correspondingly reducing undesirable stress concentration areas thereon. This, coupled with the substantially axially extending top and bottom surfaces 48 and 50 of the nose 28, permits the nose 28 to be smaller than noses with conventional configurations without appreciably reducing its operational strength. This, in turn, provides the point/adapter subassembly 12,14 with a correspondingly smaller frontal area that gives it improved earth penetration efficiency.

Coupled with the interfit between the nose bosses 62,64 and the point pocket recesses 62*a* and 64*a*, the interfit between the stabilizing tip 56 of the nose 28 and the corresponding point pocket surface area provides the mounted tooth point 12 with substantially enhanced stability against operational rotation relative to the intermediate adapter 14 about the assembly axis 22. This anti-rotational stability is further enhanced by the substantially horizontally extending top and bottom nose surfaces 48 and 50 behind the stabilizing tip 56. Moreover, the horizontal orientation of the elongated connector structure 18 places it on the "neutral" axis of the nose 28 (from the standpoint of tensile and compressive nose bending stresses), thereby desirably lessening the operational stresses imposed on the installed connector 18. The substantially horizontally extending top and bottom side surfaces 48,50 of the nose 28 further reduce the operating loads on the connector structure 18.

As can best be seen in FIGS. 1 and 2, with the tooth point 12 operatively and releasably installed on the intermediate adapter 14, the alternately scalloped rear end surface 70 of the point 12 is complementarily engaged in an interlocked fashion with the alternately scalloped front end surface 30 of the base portion 26 of the intermediate adapter 14. This unique arcuately scalloped interfit serves to stabilize the point 12 against rotation about the axis 22 relative to the intermediate adapter 14. Additionally, the rearward scalloping of the front end surface portions 30*c*,30*d* on the adapter base 26 advantageously permits the placement of the connector structure 18 further back on the adapter 14 to a somewhat thicker and thus somewhat stronger location thereon.

The interfit between the intermediate adapter 14 and the main adapter 16 is similar to the interfit between the point 12 and the intermediate adapter 14. Specifically, and with reference now to FIGS. 1–3, 6 and 7, the main adapter 16 has a rear base portion 86 and a front nose portion 88. Base portion 86 has a front end surface 90 from which the nose 88 forwardly projects, and vertically spaced apart top and bottom rearwardly extending mounting legs 92,94 which define therebetween a cavity 96 that receives a portion of the bucket lip 24. Legs 92,94 are 35 respectively welded or otherwise anchored to the top and bottom sides of the bucket lip 24 to operatively support the main adapter 16 on the bucket lip 24. The front end surface 90 of the main adapter base 86 is alternately scalloped in a front-to-rear direction around its periphery, with the top and bottom portions 90*a*,90*b* of the front end surface 90 being concavely curved in a rearward direction, and the left and right portions 90*c*,90*d* of the front end surface 90 being convexly curved in a forward direction.

The main adapter nose 88 has, along its front-to-rear length, a horizontally elongated elliptical cross-section, with top and bottom surfaces 98,100 and left and right side surfaces 102,104. Except for a slight draft angle of 5 degrees or less, the top and bottom surfaces 98,100 are substantially parallel to the assembly axis 22. At the front end of the nose 88 is a reduced cross-section stabilizing tip 106 having a horizontally elongated elliptical cross-section and top and bottom surfaces 108 and 110 which are also substantially parallel to the assembly axis 22. Laterally outwardly projecting stabilizing bosses 112 and 114 are respectively formed on the left and right side surfaces 102,104 of the adapter nose 88 at their junctures with the front surface 90 of the adapter base 86. A connector opening 116 horizontally extends through the adapter nose 88 and opens outwardly through the bosses 114 and 116.

The intermediate adapter 14 is replaceably mounted on the main adapter nose 88 by first placing the nose 88 within the intermediate adapter rear cavity or pocket 34, thereby bringing the intermediate adapter connector openings 44,46 into outwardly overlying alignment with opposite ends of the horizontally oriented main adapter nose opening 116, and then operatively inserting the rear connector pin 20 in the aligned connector openings 44,46,116. The inserted connector pin 20 is suitably retained in such openings, in a conventional manner not pertinent to the present invention, and functions to captively and releasably retain the intermediate adapter 14 on the main adapter 16, the intermediate adapter serving as a wear member for the main adapter 16 which, in turn, may be characterized as a support member for the mounted intermediate adapter 14.

The intermediate adapter cavity 34 (see FIG. 7) has an interior surface configuration complementary to that of the exterior surface of the main adapter nose 88 which it releasably receives. Specifically, the cavity 34 has a portion 88*a* configured to complementarily receive the body of the inserted main adapter nose 88, and left and right interior side wall recesses 112*a*,114*a* that respectively and complementarily receive the inserted main adapter nose stabilizing bosses 112 and 114. Connector openings 44,46 respectively extend laterally inwardly into the recesses 112*a*,114*a*.

The unique shapes of the intermediate adapter 14 and the main adapter 16 provide the intermediate adapter/main adapter subassembly 14,16 with a variety of advantages compared to conventional excavating wear member/support member assemblies. For example, the horizontally elongated elliptical cross-sectional shape of the adapter nose 88 substantially eliminates planar areas on the nose 88, thereby correspondingly reducing undesirable stress concentration areas thereon. This, coupled with the substantially axially extending top and bottom surfaces of the nose 88, permits the nose 88 to be smaller than noses with conventional configurations without appreciably reducing its operational strength. This, in turn, provides the intermediate adapter/main adapter subassembly 14,16 with a correspondingly smaller frontal area that gives it improved earth penetration efficiency.

Coupled with the interfit between the nose bosses 112,114 and the point pocket recesses 112*a* and 114*a,* the interfit between the stabilizing tip 106 of the nose 88 and the corresponding intermediate adapter pocket interior surface area provides the mounted intermediate adapter 14 with a substantially enhanced stability against operational rotation relative to the main adapter 16 about the assembly axis 22. This anti-rotational stability is further enhanced by the substantially horizontally extending top and bottom nose surfaces 108 and 110 behind the stabilizing tip 106. Moreover, the horizontal orientation of the elongated connector structure 20 places it on the "neutral" axis of the nose 88 (from the standpoint of tensile and compressive nose bending stresses), thereby desirably lessening the operational stresses imposed on the installed connector structure 20. The substantially horizontally extending top and bottom surfaces 108,110 of the nose 88 further reduce the operating loads on the connector structure 20.

As can best be seen in FIGS. 1 and 2, with the intermediate adapter 14 operatively and releasably installed on the main adapter 16, the alternately scalloped rear end surface 32 of the intermediate adapter 14 is complementarily engaged in an interlocked fashion with the alternately scalloped front end surface 90 of the base portion 86 of the main adapter 16. This unique arcuately scalloped interfit serves to stabilize the intermediate adapter 14 against rotation about the axis 22 relative to the main adapter 16 about the assembly axis 22. Additionally, the rearward scalloping of the front end surface portions 90*a,*90*b* on the main adapter base 86 advantageously positions top and bottom rear wall portions of the intermediate adapter 14 in an overlying, abrasion-protecting relationship with corresponding front top and bottom portions of the main adapter 16 thereby desirably increasing the operating life of the main adapter 16.

While the excavating tooth point and adapter assembly 10 has been representatively depicted herein as including a two piece adapter section, it will be readily appreciated by those of skill in this particular art that the two adapter portions 14 and 16 Could be replaced with a single adapter member if desired. Additionally, while the assembly 10 has been representatively depicted herein as being defined by point and adapter structures, it could be alternatively formed from other types of associated wear and support members if desired.

The foregoing detailed description is to be clearly understood as being given by way of illustration and example only, the spirit and scope of the present invention being limited solely by the appended claims.

What is claimed is:

1. An excavating equipment wear member comprising:

front and rear ends spaced apart along an axis;

a cavity extending forwardly through said rear end and configured to complementarily receive a nose portion of a support member, said cavity having along substantially its entire front-to-rear length a horizontally elongated, generally elliptical cross-section and being laterally circumscribed by vertically spaced top and bottom walls having vertically facing opposing interior side surfaces extending forwardly from said rear end, and horizontally spaced opposite side walls extending between said top and bottom walls and having horizontally opposing interior side surfaces;

a horizontally facing pair of recesses formed in said interior side surfaces of said opposite side walls and opening rearwardly through said rear end; and a horizontally opposed pair of connector openings extending inwardly through said opposite side walls into said recesses.

2. The excavating equipment wear member of claim 1 wherein:

said excavating equipment wear member is a replaceable tooth point.

3. The excavating equipment wear member of claim 1 wherein:

said excavating equipment wear member is an adapter.

4. The excavating equipment wear member of claim 1 wherein:

said vertically facing opposing interior side surfaces of said top and bottom walls are substantially parallel to said axis.

5. The excavating equipment wear member of claim 4 wherein:

said vertically facing opposing interior side surfaces of said top and bottom walls extend along essentially the entire front-to-rear length of said cavity.

6. The excavating equipment wear member of claim 5 wherein:

said vertically opposing interior side surfaces of said top and bottom walls have front portions which are vertically inset from the balance of said vertically opposing interior side surfaces of said top and bottom walls.

7. The excavating equipment wear member of claim 1 wherein:

said recesses extend forwardly from said rear end through only a portion of the front-to-rear length of said cavity.

8. The excavating equipment wear member of claim 1 wherein:

said recesses have generally rectangular cross-sections.

9. The excavating equipment wear member of claim 1 wherein:

said rear end has an alternately scalloped, rearwardly facing surface circumscribing the entrance to said cavity.

10. The excavating equipment wear member of claim 9 wherein:

said alternately scalloped surface is defined by peripherally alternating forwardly and rearwardly curved portions.

11. The excavating equipment wear member of claim 1 wherein:

said top and bottom walls have forwardly concave arcuate rear end surfaces, and said opposite side walls have rearwardly convex arcuate rear end surfaces.

12. The excavating equipment wear member of claim 1 wherein:

said top and bottom walls have rearwardly convex arcuate rear end surfaces, and said opposite side walls have forwardly concave arcuate rear end surfaces.

13. An excavating equipment support member extending lengthwise along a front-to-rear axis and comprising:

a rear base portion having top and bottom sides, horizontally opposite left and right sides, and a front end surface;

a nose portion projecting forwardly from said front end surface and being complementarily receivable in a rear end cavity of a wear member, said nose portion having a horizontally elongated, generally elliptical cross-section along substantially its entire front-to-rear length, top and bottom surfaces, and horizontally opposite left and right side surfaces;

horizontally opposite stabilizing projections disposed on and projecting laterally outwardly from said left and right side surfaces; and a connector opening extending horizontally through said nose portion and opening outwardly through said stabilizing projections.

14. The excavating equipment support member of claim 13 wherein:

said support member is an adapter.

15. The excavating equipment support member of claim 14 wherein:

said adapter has a rear end cavity configured to complementarily receive a nose portion of another adapter.

16. The excavating equipment support member of claim 14 wherein:

said adapter has a rear end portion securable to a portion of an excavating bucket lip.

17. The excavating equipment support member of claim 16 wherein:

said rear end portion of said adapter includes vertically spaced top and bottom rearwardly extending mounting legs having a cavity therebetween adapted to receive the bucket lip portion.

18. The excavating equipment support member of claim 13 wherein:

said top and bottom surfaces of said nose portion are substantially parallel to said axis.

19. The excavating equipment support member of claim 18 wherein:

said top and bottom surfaces of said nose portion have front portions which are vertically inset from the balance of said top and bottom surfaces.

20. The excavating equipment support member of claim 13 wherein:

said stabilizing projections are stabilizing bosses which are positioned adjacent said front end surface of said rear base portion and extend through only a portion of the front-to-rear length of said nose portion.

21. The excavating equipment support member of claim 20 wherein:

said stabilizing bosses have generally rectangular cross-sections.

22. The excavating equipment support member of claim 13 wherein:

said front end surface of said rear base portion circumscribes the rear end of said nose portion.

23. The excavating equipment support member of claim 22 wherein:

said front end surface of said rear base portion has an alternately scalloped configuration.

24. The excavating equipment support member of claim 23 wherein:

said alternately scalloped configuration is defined by peripherally alternating forwardly and rearwardly curved portions of said front end surface of said rear base portion.

25. The excavating equipment support member of claim 13 wherein:

top and bottom portions of said front end surface of said rear base portion have forwardly convex arcuate configurations, and left and right side portions of said front end surface of said rear base portion have rearwardly concave arcuate configurations.

26. The excavating equipment support member of claim 13 wherein:

top and bottom portions of said front end surface of said rear base portion have rearwardly concave arcuate configurations, and left and right side portions of said front end surface of said rear base portion have forwardly convex arcuate configurations.

27. An excavating equipment wear member/support member assembly extending lengthwise along a front-to-rear axis and comprising:

a support member having a rear base portion with top and bottom sides, horizontally opposite left and right sides, and a front end surface; a nose portion projecting forwardly from said front end surface and having a horizontally elongated, generally elliptical cross-section along substantially its entire front-to-rear length, top and bottom surfaces, and horizontally opposite left and right surfaces; horizontally opposite stabilizing projections disposed on and projecting laterally outwardly from said left and right surfaces of said nose portion; and a connector opening extending horizontally through said nose portion and opening outwardly through said stabilizing projections;

a wear member having a rear end cavity complementarily and releasably receiving said nose portion, and horizontally opposite side walls with connector openings extending therethrough into said cavity and being in outwardly overlying alignment with opposite ends of said connector opening in said nose portion; and a connector structure received in said connector openings of said nose portion and said wear member and captively retaining said wear member on said nose portion.

28. The assembly of claim 27 wherein:

said wear member is a replaceable tooth point, and said support member is an adapter.

29. The assembly of claim 28 wherein:

said adapter is an intermediate adapter.

30. The assembly of claim 27 wherein:

said wear member is a first adapter, and said support member is a second adapter.

31. The assembly of claim 30 wherein:

said second adapter is adapted to be operatively secured to a portion of an excavating bucket lip.

32. The assembly of claim 27 wherein:

said top and bottom surfaces of said nose portion are substantially parallel to said axis.

33. The assembly of claim 32 wherein:

said top and bottom surfaces of said nose portion have front portions which are vertically inset from the balance of said top and bottom surfaces.

34. The assembly of claim 27 wherein:

said stabilizing projections are stabilizing bosses which are positioned adjacent said front end surface of said rear base portion and extend through only a portion of the front-to-rear length of said nose portion.

35. The assembly of claim 34 wherein:

said stabilizing bosses have generally rectangular configurations.

36. The assembly of claim 27 wherein:

said front end surface of said rear base portion of said support member circumscribes the rear end of said nose portion of said support member.

37. The assembly of claim 36 wherein:

said front end surface of said rear base portion of said support member and a rear end surface of said wear member are alternately scalloped in front-to-rear directions and are in a complementarily interlocked relationship.

38. The assembly of claim 37 wherein:

said front end surface of said rear base portion of said support member and said rear end surface of said wear member have peripherally alternating forwardly and rearwardly curved portions.

39. The assembly of claim 37 wherein:

top and bottom portions of said front end surface of said rear base portion of said support member have forwardly convex arcuate configurations, and left and right side portions of said front end surface of said rear base portion of said support member have rearwardly concave arcuate configurations.

40. The assembly of claim 37 wherein:

top and bottom portions of said front end surface of said front end surface of said rear base portion of said support member have rearwardly concave arcuate configurations, and left and right side portions of said front end surface of said rear base portion of said support member have forwardly convex arcuate configurations.

* * * * *